US006865823B1

(12) United States Patent
Vindriis

(10) Patent No.: US 6,865,823 B1
(45) Date of Patent: Mar. 15, 2005

(54) INSOLE WITH FABRIC

(76) Inventor: Søren Vindriis, Tulipanparken 43, DK-8700, Horsens (DK)

( * ) Notice: Subject to any disclaimer, the term of this patent is extended or adjusted under 35 U.S.C. 154(b) by 0 days.

(21) Appl. No.: 09/830,242

(22) PCT Filed: Oct. 15, 1999

(86) PCT No.: PCT/DK99/00558

§ 371 (c)(1),
(2), (4) Date: Apr. 24, 2001

(87) PCT Pub. No.: WO00/24283

PCT Pub. Date: May 4, 2000

(30) Foreign Application Priority Data

Oct. 27, 1998 (DK) ..... PA 1998 01382

(51) Int. Cl.[7] ..... A43B 13/20; A43B 13/38; A43B 23/00; A43B 7/14; A61F 5/14

(52) U.S. Cl. ..... 36/29; 36/44; 36/153

(58) Field of Search ..... 36/43, 44, 29, 36/153

(56) References Cited

U.S. PATENT DOCUMENTS

| | | | | |
|---|---|---|---|---|
| 3,730,169 A | | 1/1973 | Fiber | |
| 3,724,106 A | * | 4/1973 | Magidson | 36/44 |
| 3,914,881 A | * | 10/1975 | Striegel | 36/44 |
| 4,017,931 A | | 4/1977 | Golden | |
| 4,137,110 A | * | 1/1979 | Singh | 156/62.2 |
| 4,906,502 A | | 3/1990 | Rudy | |
| 5,025,575 A | | 6/1991 | Lakic | |
| 5,067,255 A | | 11/1991 | Hutcheson | |
| 5,714,229 A | * | 2/1998 | Ogden | 428/138 |
| 5,753,357 A | * | 5/1998 | Filipitsch et al. | 428/307.7 |
| 5,778,561 A | * | 7/1998 | Shimoyama | 36/43 |

FOREIGN PATENT DOCUMENTS

| | | |
|---|---|---|
| EP | 0699520 | 6/1996 |

* cited by examiner

*Primary Examiner*—Anthony Stashick
(74) *Attorney, Agent, or Firm*—James Creighton Wray; Meera P. Narasimhan

(57) ABSTRACT

The invention relates to an insole for footwear. The insole comprises a top foil and a bottom foil in between which a number of cavities are formed containing liquid or gel. The top foil and/or bottom foil are equipped with fabric which in the plane of the fabric has a tensile strength that is higher than the tensile strength of the top and/or the bottom foil. Thereby, the fabric prevents creep of the plastic of which the top foil and/or the bottom foil usually are made. Preferentially, the fabric is joined with the foil such that the fabric extends on the outside or at least to the outside the foil. Thereby, the fabric constitutes a layer between the sole and the bottom of the footwear and, respectively, between the sole and the foot or the sock/stocking on the foot. Thereby, it is possible to select the frictional conditions such that the sole lies firmly in the footwear and such that the foot slides easily on the sole in order to reduce the formation of heat to the foot as a result of friction.

11 Claims, 1 Drawing Sheet

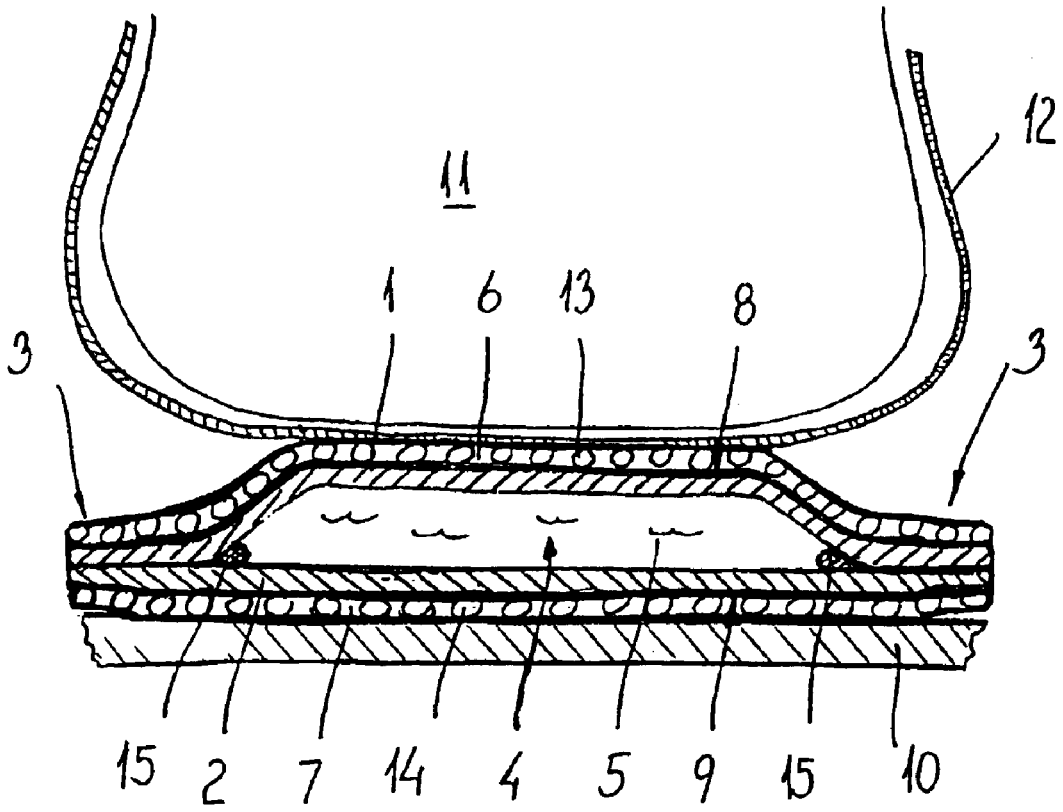
11
12
1
6
13
8
3
3
15
2
7
14
4
5
9
15
10

INSOLE WITH FABRIC

The present invention relates to an insole for footwear.

The soles are intended for the relief of the foot, in particular the sole of the foot, by pressure equalisation, as pain in the foot and the sole of the foot is most cases is caused by concentration of pressure. Known soles use liquid contained in one or more cavities. The pressure of the contained liquid is approximately constant, and the soles will then allocate the pressure from the foot over a larger area, whereby pain in the foot or the sole of the foot is reduced. However, it is known that many kinds of material during constant load even below the yield point show permanent cold flow or creep.

The soles also have the disadvantage, that they cold flow or creep due to the continueing load, to which the soles are exposed. Thereby, the inner volume of the cavities increases so that the pressure-equalising effect is reduced and, along with that, the pain relieving effect. Furthermore, the temperature in footwear is between 20° C. and 40° C. in which temperature range, the used plastic foils show a relatively large coefficient of expension for heat and a relatively large change of elasticity. As a result, the relief decreases as the sole gets warmer.

DE 40 01 542 describes such a sole, where the cavities are filled with a gas. By using a gas, a higher degree of shock absorption and/or continueing pressure equalisation is obtained, but the gas is more volatile than a liquid. Therfore, it is important that those foils which are used in such a sole have a sufficient low permeability for the used gas. To decrease the possibility of incorporating a film of, for example, polyethylene or polyurethane in the foils forming the cavities is described. This increases partly the impermeability of the foils and partly the strength with regard to creep. The strength with regard to creep comes about by formation of a chemical coupling between the plastic making up the foil and the film contained in the foils.

It is a disadvantage that it is necessary to enclose the film in the foils, and for cavities filled with gas, diffusion of the gas is a much bigger problem than creep. The selection of materials for the film and the way the film is enclosed in the foils is, therefore, primarily directed towards the purpose of increasing the impermeability rather than increasing the strength with regard to creep. This influences the selection of material, the selection of technique for joining the film and the foil, and the choice that the film is enclosed in the foils.

According to prior art, insoles are kown to be covered with different kind of fabric. However, the function of this kind of coverage, as for instance described in U.S. Pat. No. 5,067,255, and No. 5,025,575 is to increases the comfort. From U.S. Pat. No. 3,703,169, an insole is known with an upper layer that is bonded to the insole by means of an adhesive. The upper layer is formed of a material to facilitate the easy insertion of the wearer's foot into the shoe. The fabric covers described in theses patents have no described influence on the stability of the insoles.

From U.S. Pat. No. 4,906,502, a pressurised insole is known, where the insole is equipped with a fabric inside the insole to maintain the planar structure of the pressurised insole. However, the fabric does not prevent creep of the outer covering.

It is the object of the present invention to provide an insole that is primarily intended for cavities filled with liquid, and where the strength with regard to creep of the foils is essentially higher than for known soles, irrespective of whether they are intended for liquids, gasses or gels.

This object is accomplished with an insole for footwear comprising a plastic top foil and a plastic bottom foil; and one or more cavities, which are formed between the top foil and the bottom foil and filled with liquid or a gel; wherein the top foil and the bottom foil are impermeable with respect to the liquid or gel and are joined together at least along an edge region; wherein the top foil as well as the bottom foil are equipped with a fabric extending between the foils and between the edge region, where the top foil is joined with the bottom foil; wherein the fabric extends parallel with the foil; and wherein the fabric is joined with the foil by at least partially enclosing the fabric in the foil to reinforce the mechanical strength of the foil; where the foil is initially heated up; the fabric is partly or totally pressed into the foil whereby that part of the fabric which is pressed into the foil is partly or totally enclosed in the foil; and the foil is cooled down.

An insole, where the foils are equipped with a fabric instead of discrete fibres and where the joining is done mechanically, implies that it is possible to undertake a precise increment of the mechanical strength of the foils by selection of specific materials and specific textures of the fabric, and also by selection of a certain orientation of the fabric in connection with the foil and in connection with the finally fabricated sole.

The selection of fabric depends primarily on the tensile strength of the fibres in the fabric because the strength of the fibres. The selection of the fabric can also, or the together with, depend on the want to increase the friction between the sole and the inside of the footwear and the to decrease the friction between the sole and the foot in the footwear. Increase of the friction between the fabric on the bottom foil and the inside of the footwear results in a much better securing of the sole in the footwear than if the friction was due to the bottom foil and the footwear. Decrease of the friction between the fabric on the top foil and the foot results in an easier gliding of the foot on the sole, which reduces the frictional heat, which arises from running or walking.

The invention will hereafter be described more detailed with reference to the accompanying drawing that shows a sectional view of an embodiment of an insole according to the invention.

The sole comprises a top foil 1 and bottom foil 2. The top foil 1 and the bottom foil 2 are joined along the edge region 3, and between the top foil and the bottom foil a cavity 4 is formed. The cavity is filled with liquid 5, for example water. The cavity 4 can also be filled with a gel, and also other liquids than water can be contained in the cavity 4. In the shown embodiment, the top foil 1 as well as the bottom foil 2 are equipped with fabrics 6, 7. The fabrics 6, 7 are joined with the foils 1, 2 so that the fabrics 6, 7 extend on an outer side 8, 9 of the foils 1, 2. Underneath the sole, the bottom 10 of a footwear is shown, and above the sole, a foot 11 with a sock 12 or a stocking is shown.

The fabrics 6, 7 are joined with the foils 1, 2, preferentially with the fibres 13, 14 in the fabrics 6, 7 situated outside an outer side of the foils.

The joining is done in a way that the fabrics 6, 7 are partly enclosed in the foils 6, 7. The fabrics 6, 7 are, thus, joined with the foils 1, 2 by heating the foils 1, 2 whereafter the fabrics 6, 7 are pressed partly into the foils 1, 2. In an alternative embodiment, however, the fabrics 6, 7 can be joined such that the fabrics are entirely enclosed in the foils 1, 2. The fabrics are, thus, joined with the foils 1, 2 by heating the foils 1, 2 whereafter the fabrics 6, 7 are pressed entirely into the foils 1, 2.

The foils 1, 2 are made from plastic. Joining of the foils 1, 2 along the edge region is accomplished by hot welding or high frequency welding where the top foil 1 and the bottom foil a are pressed together along the edge region 3 at the same time. By the welding, a bead 15 is formed extending inwards into the cavity 4. The bead 15 is formed because the material floats inwards at the location where the welding and the pressing takes place. When liquid 5 of gel subsequently is filled in between to top foil 1 and the bottom foil 2, the cavity 4 is formed.

By the formation of the cavity 4, the top foil 1 gets stretched. The thickness t of the material along that part of the top foil 1, which extend in the near vicinity of an from the welding has a thickness which is smaller then the thickness T of the material in the remaining part of the top foil 1. Under load, there is, along that part of the top foil which is stretched, a risk for breakage as a result of creep that can occur in that part, where the strength of the top foil is decreased because of the smaller material thickness t.

The fabrics 6, 7 can be of any kind of fabric with fibres 13, 14. The fabrics 5, 7 can be made of synthetic materials as polyester or of natural materials as cotton, or a mixture of fibres of different materials. Furthermore, the fabrics 6, 7 can be woven fabrics, knitted fabrics, or non-woven fabrics. As mentioned, the fabrics 6, 7 extend outside the outer sides 8, 9 of the foils 1, 2.

The fabrics 6, 7 are selected due to given mechanical and physical characteristics. Primarily, it is important that the fibres 13, 14 in the fabrics 6, 7 and the fabrics 6, 7 themselves in the plane of the fabrics 6, 7 have a tensile strength which is higher than the comparable tensile strength of the foils 1, 2 so to ensure a reduction or elimination of creep. Secondarily, the fabrics 6, 7 are selected to make allowance for needs and wants for friction, moisture absorption and other factors in connection with comfort for the foot. Thus, the fabric 14 in the bottom foil 2 is selected secondarily to provide a high frictional coefficient between that part of the fabric that extends outside the bottom foil 2 and the bottom 10 of the foot wear. The fabric 13 in the top foil 2 on the other hand is selected secondarily to provide a low frictional coefficient between that part of the fabric 13 which extends outside the topfoil 1 and the foot 11.

The foot 11 is normally furnished with an article clothing as, for example, a cotton sock or a nylon. The fabric 13 and the material of which the fabric 13 is made is, therefore, selected based on the want of a low frictional coefficient in connection with conventional textile used for socks and stockings. Furthermore, the fabric 13 on the top foil 1 can be impregnated with a fungicide to reduce the risk for epidermophytoses.

The invention is described above with reference to a sectional view of sole according to the invention. The sectional view is only a schematic picture of a section through a sole in as much as other soles according to the invention could look different depending on where in the sole the section is made. Also, the configuration of the cavity 4 and the distribution of eventual further cavities can imply that the sectional view is different at other locations in the sole or in other soles. Furthermore, it can occur for some sections, that there is no cavity along that section, which also is dependent on, where in the sole the section is located. It is also possible to produce soles with one or more intermediate foils placed between the top foil and the bottom foil and eventually provided with fabrics. It is possible to provide only the top foil, only the intermediate foil, or only the bottom foil with fabric.

Furthermore, it is possible to provide the foils 1, 2 with several fabrics with different mechanical and physical characteristics to selectively make allowance for primarily the strength of the fibres 13, 14 and the fabrics 6, 7 and secondarily the frictional coefficient between the fibres, the fabrics, the bottom of the footwear, the sock and/or the foot. This can imply that at least two fabrics with different fibres or different weaves are used in the same foil or, respectively, in the top foil or bottom foil. In this case, one fabric completely contained in the foil can be provided causing strength and a second fabric, which, as shown, in found at the outer side 8, 9, of the foils or is only partly contained in the foils 1, 2, concerns the frictional coefficient at the bottom of the footwear, respectively the foot, eventually with sock or stocking.

What is claimed is:

1. An insole for footwear comprising:

a plastic top foil and a plastic bottom foil having edge regions;

and one or more cavities formed between the top foil and the bottom foil and filled with a liquid or a gel;

wherein the top foil and the bottom foil are impermeable with respect to the liquid or gel and are joined together at least along the edge regions;

wherein at least one of said foils is equipped with a fabric extending over an outer surface of said at least one of said foils;

wherein the fabric extends parallel with said at least one of said foils; and wherein the fabric is joined with said at least one of said foils by at least partially pressing the fabric into said at least one of said foils such that the fabric penetrates below an exterior surface of said at least one of said foils for reinforcing the mechanical strength of the foil against creep.

2. An insole according to claim 1, wherein the bottom foil is equipped with the fabric, and a frictional coefficient between the bottom foil equipped with the fabric and a substantially smooth surface in a bottom of the footwear is larger than a frictional coefficient between the bottom foil without the fabric and the substantially smooth surface in the bottom of the footwear.

3. An insole according to claim 1, wherein the top foil is equipped with the fabric and the frictional coefficient between the top foil equipped and impregnated with fabric and a foot covering textile such as cotton, polyester or nylon is lower than a frictional coefficient for the top foil without the fabric and the foot covering textile.

4. An insole according to claim 1, wherein the fabric is made of fibers and is woven such that the fabric in every direction in the plane of the fabric has a tensile strength that is higher than a tensile strength of said at least one of the foils in any direction planar with said at least one of the foils.

5. An insole according to claim 1, wherein the fabric is joined with the top foil and is impregnated with a fungicide.

6. A method for production of an insole for footwear comprising:

providing a plastic top foil and a plastic bottom foil, the top foil and the bottom foil being impermeable to liquid;

joining the top foil and the bottom foil together at least along edge regions;

forming one or more cavities between the top foil and the bottom foil;

filling the cavities with a liquid or a gel; and equipping at least one of said foils with a fabric for reinforcing the mechanical strength of said at least one of said foils against creep, the fabric extending over said at least one of said foils;

initially heating said at least one of said foils;

pressing the fabric partly or totally into said at least one of said foils whereby that part of the fabric which is pressed into the foil is partly or totally in said at least one of said foils such that the fabric penetrates below an exterior surface of said at least one of said foils; and cooling the foil.

7. An insole for footwear comprising a plastic top foil and a plastic bottom foil, one or more cavities formed between the top foil and the bottom foil and filled with a liquid, wherein the top foil and the bottom foil are impermeable with respect to the liquid or gel and are joined together at least along edge regions of the top foil and the bottom foil, wherein the top foil and the bottom foil are equipped with fabrics extending on the foils between the edge regions where the top foil is joined with the bottom foil, wherein the fabrics extend parallel with the foils, and partially extend outside of the outer sides of the foils, wherein the fabrics are joined with the foils by mechanical joining and partial enclosure in the foils for reinforcing mechanical strength of the foils against creep, wherein in the mechanical joining the foils initially are heated, the fabrics subsequently are pressed partly into the foils, and the foils finally are cooled, whereby at least parts of the fabrics which are pressed into the foils are enclosed in the foils.

8. An insole according to claim 7, wherein the fabrics differ and the bottom foil is equipped with a fabric which with respect to a substantially smooth surface in the bottom of the footwear has a frictional coefficient which is larger than a frictional coefficient of the bottom foil with respect to the substantially smooth surface in the bottom of the footwear.

9. An insole according to claim 7, wherein the top foil is equipped with a fabric which with respect to a foot covering textile such as cotton, polyester or nylon has a frictional coefficient which is lower than a frictional coefficient of the top foil with respect to the foot covering textile.

10. An insole according to claim 7, wherein the fabrics are made of fibers and are woven such that the fabrics in every direction in the plane of the fabrics have tensile strengths higher than tensile strengths of one of the foils in any direction planar with the foils.

11. An insole according to claim 7, wherein a fabric which is joined with the top foil is impregnated with a fungicide.

* * * * *